US007077096B2

(12) United States Patent
Matsuda

(10) Patent No.: US 7,077,096 B2
(45) Date of Patent: Jul. 18, 2006

(54) MULTI-CYLINDER ENGINE

(75) Inventor: Minoru Matsuda, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 16 days.

(21) Appl. No.: 10/896,168

(22) Filed: Jul. 22, 2004

(65) Prior Publication Data

US 2005/0109290 A1 May 26, 2005

(30) Foreign Application Priority Data

Jul. 25, 2003 (JP) ..... 2003-279671

(51) Int. Cl.
*F01M 1/06* (2006.01)
*F01P 1/04* (2006.01)

(52) U.S. Cl. ..... 123/196 R; 123/41.38

(58) Field of Classification Search ..... 123/196 R, 123/195 R, 195 H, 55.2, 55.5, 55.7, 197.4, 123/192.2, 191.1, 41.35, 41.38; 74/604
See application file for complete search history.

(56) References Cited

U.S. PATENT DOCUMENTS 1,329,038 A * 1/1920 Curtiss ..... 194/6.2
6,536,399 B1 * 3/2003 Matsuda et al. ..... 123/195 R

FOREIGN PATENT DOCUMENTS

JP 2002-213302 A 7/2002

* cited by examiner

*Primary Examiner*—Henry C. Yuen
*Assistant Examiner*—Hyder Ali
(74) *Attorney, Agent, or Firm*—Birch, Stewart, Kolasch & Birch, LLP

(57) ABSTRACT

In a multi-cylinder engine, a decrease of the load capacity of a main metal bearing between a bearing portion of a crankcase and a crank journal is prevented to achieve a reduction in the scale and a reduction in the weight of the engine while lubricating oil is supplied between a major end portion of a connecting rod and a crankpin. A pair of outermost crank journals are disposed most outwardly along an axial line of a crankshaft from among a plurality of crank journals have a length in the axial direction set greater than the length of the remaining crank journals in the axial direction. Crankpin oil paths extending from at least one of the two outermost crank journals to the crankpins are provided in the crankshaft while an oil supply source is connected to the crankpin oil paths at least at one of the outermost crank journals.

20 Claims, 10 Drawing Sheets

MULTI-CYLINDER ENGINE

CROSS-REFERENCE TO RELATED APPLICATIONS

The present application claims priority under 35 USC 119 to Japanese Patent Application No. 2003-279671 filed on Jul. 25, 2003 the entire contents thereof is hereby incorporated by reference.

BACKGROUND OF THE INVENTION

1. Field of the Invention

This invention relates to a multi-cylinder engine, and more particularly to a multi-cylinder engine wherein a crankshaft is provided on which a plurality of crank journals are individually rotatably supported through main metal bearings on a plurality of bearing portions provided on a crankcase and crankpins to which major end portions of connecting rods are integrally provided and are connected for pivotal motion. The crankpin oil paths are provided for supplying lubricating oil between the major end portions of the connecting rods and the crankpins.

2. Description of Background Art

Conventionally, in a multi-cylinder engine disclosed, for example, in Japanese Patent Laid-open No. 2002-213302, the crankpin oil paths are provided in a crankshaft in such a manner as to connect a plurality of crank journals provided on the crankshaft and crankpins.

Incidentally, a metal bearing is interposed between a crank journal of a crankshaft and a bearing portion of a crankcase. In the conventional multi-cylinder engine described above, in order to establish communication between the crankpin oil paths provided between crank journals and the crankpins and the oil supply paths provided in bearing portions on which the crank journals are supported, annular oil grooves are provided at central portions of metal bearings in the axial direction. Therefore, the area of the metal bearings for supporting a load decreases and the load capacity of the metal bearings decreases. Accordingly, in order to sufficiently assure the load capacity of each metal bearing, it cannot be avoided to set the width of the metal bearings, that is, the length of the crank journals in the axial direction, comparatively great. This gives rise to an increase in the scale and an increase in the weight of the engine in the axial direction of the crankshaft.

SUMMARY AND OBJECTS OF THE INVENTION

The present invention has been made in view of such a circumstance as described above. It is an object of the present invention to provide a multi-cylinder engine wherein a decrease in the load capacity of a metal bearing between a bearing portion of a crankcase and a crank journal is prevented to achieve a reduction in scale and a reduction in the weight of the engine while lubricating oil can be supplied between a major end portion of a connecting rod and a crankpin.

In order to attain the object described above, according to the present invention, a multi-cylinder engine is provided wherein a crankshaft on which a plurality of crank journals are individually rotatably supported through main metal bearings on a plurality of bearing portions provided on a crankcase and crankpins to which major end portions of connecting rods are pivotally connected and are provided integrally. Crankpin oil paths for supplying lubricating oil between the major end portions of the connecting rods and the crankpins include the pair of outermost crank journals disposed most outwardly along an axial line of the crankshaft from among the plurality of crank journals and have a length in the axial direction set greater than the length of the remaining crank journals in the axial direction. In addition, the crankpin oil paths extending from at least one of the two outermost crank journals to the crankpins are provided in the crankshaft while an oil supply source is connected to the crankpin oil paths at least at one of the outermost crank journals.

According to the present invention, the multi-cylinder engine includes oil jets for jetting cooling oil toward pistons slidably fitted in cylinder bores that are attached to selected ones of the bearing portions on which the remaining crank journals and are rotatably supported. The oil jetting oil paths for introducing the oil to the oil jets are provided in the selected bearing portions. The crankpin oil paths and the oil jetting oil paths are connected in parallel to the oil supply source.

According to the present invention, the multi-cylinder engine includes a pair of cylinder barrels having cylinder bores that are offset in a direction along the axial line of the crankshaft and are coupled to the crankcase.

According to the present invention, the pair of outermost crank journals disposed most outwardly along the axial line of the crankshaft from among the plurality of crank journals do not have a significant influence on an increase in the scale of the engine in the direction along the axial line of the crankshaft even if the length thereof in the axial direction is set to be long to some degree. Further, the crankpin oil paths extending to the crankpins from at least one of the outermost crank journals whose length in the axial direction is set comparatively great in this manner are provided in the crankshaft. Therefore, for each of the remaining crank journals, it is unnecessary to provide an annular oil groove on a main metal bearing for allowing communication of oil with the crankpin oil path. Therefore, even with the remaining crank journals whose length in the axial direction is set comparatively small, the load capacity of the main metal bearings can be assured sufficiently. Accordingly, it is possible to prevent a reduction of the load capacity of all of the main metal bearings and to achieve a reduction in the scale and a reduction in the weight of the engine while the lubricating oil can be supplied between the major end portions of the connecting rods and the crankpins.

Further, according to the present invention, the pistons are cooled by the oil jets while a sufficient amount of oil can be supplied between the major end portions of the connecting rods and the crankpins, which can contribute to an improvement in durability.

Furthermore, according to the present invention, the multi-cylinder engine can be applied suitably to a horizontally opposed type or V-type multi-cylinder engine.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

An embodiment of the present invention is described in connection with a working example of the present invention shown in the accompanying drawings.

FIGS. 1 to 9 show a working example where the present invention is applied to a four-cycle horizontally opposed type four-cylinder engine.

Figure 1:
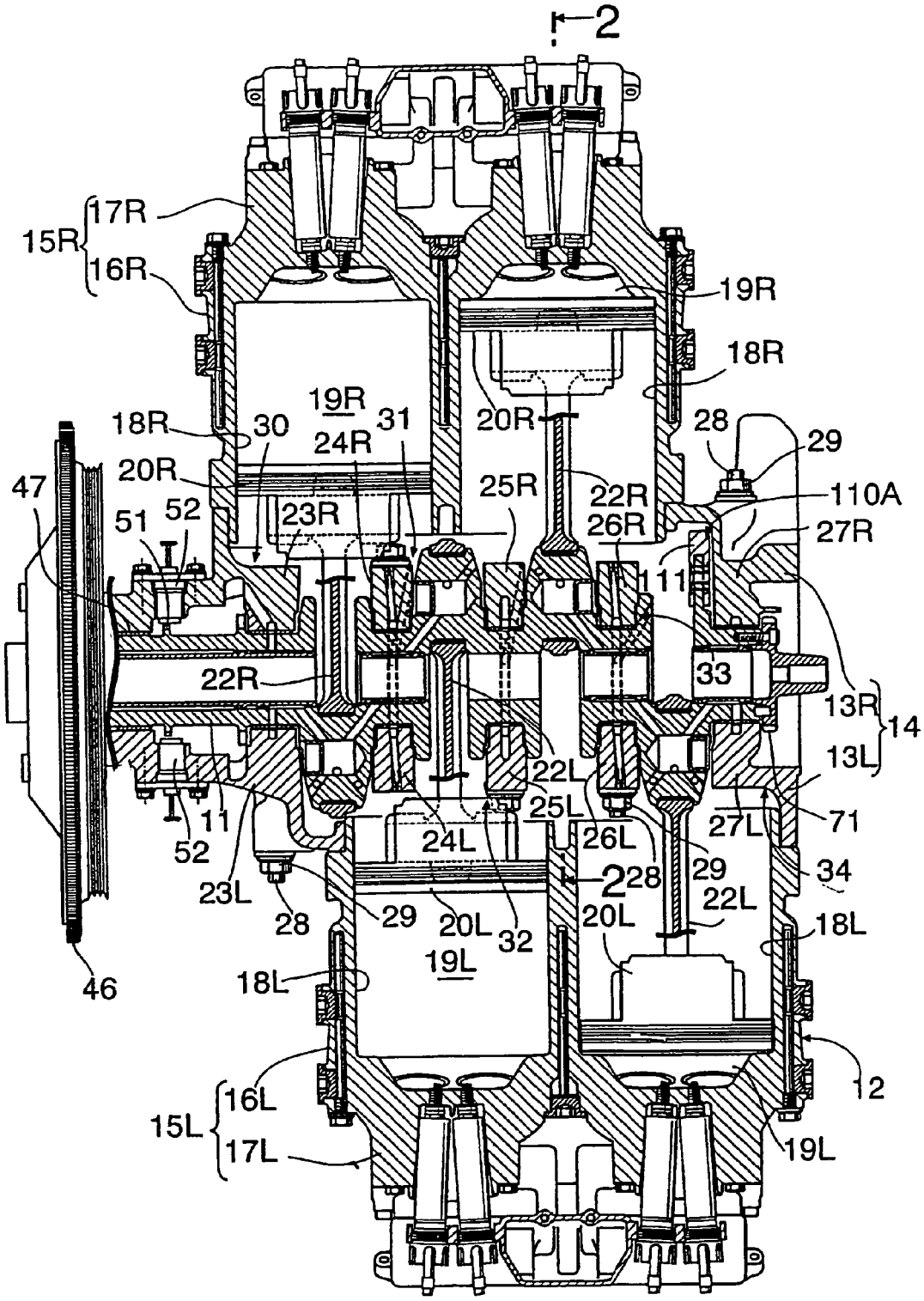
FIG. 1 is a transverse sectional plan view of an engine.
Figure 2:
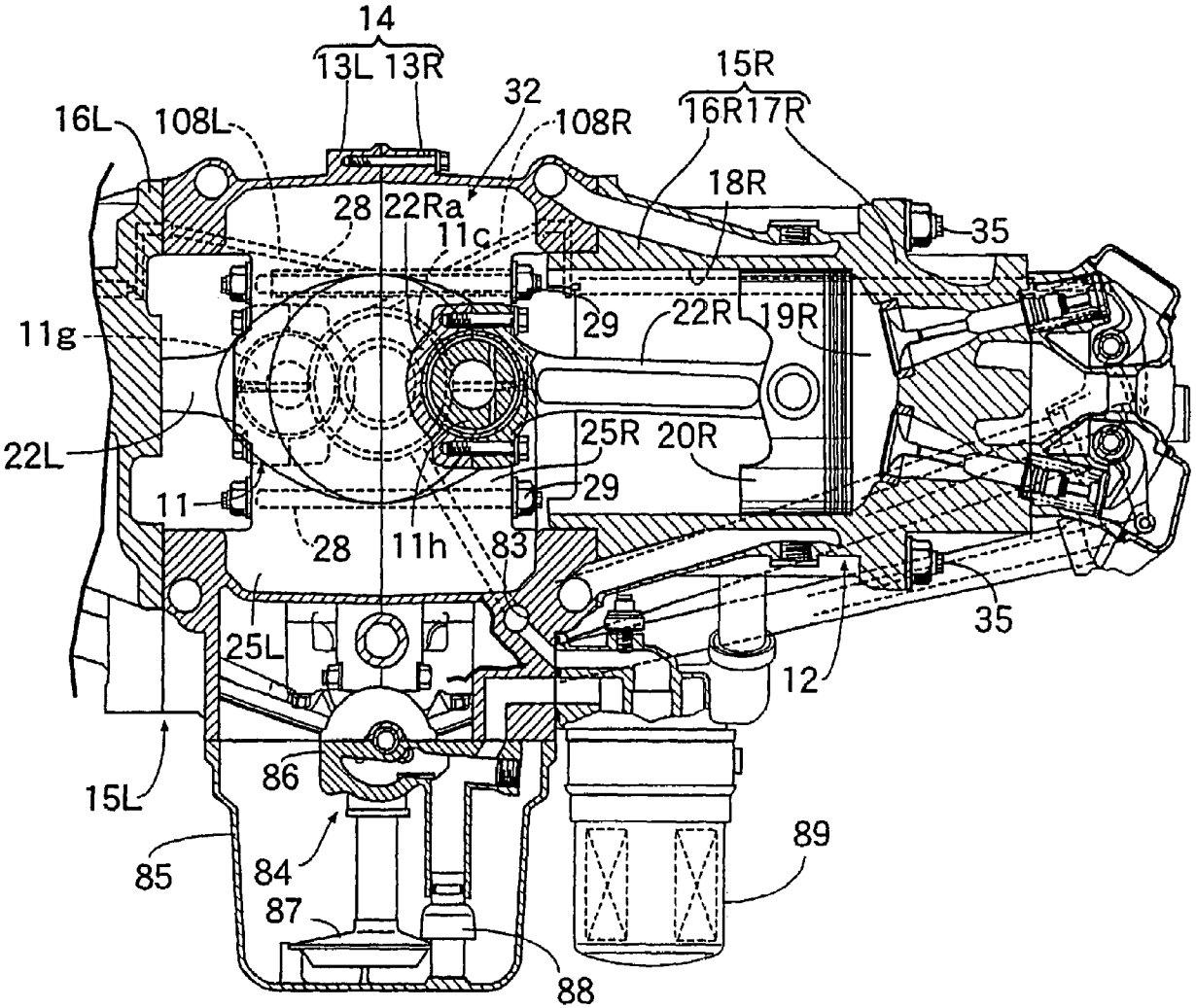
FIG. 2 is a sectional view taken along line 2—2 of FIG. 1.

Referring first to FIGS. 1 and 2, the four-cycle horizontally opposed type four-cylinder engine is incorporated, for example, in an airplane and accommodated in a front cowl of a body of the airplane such that an axial line of a crankshaft 11 extends in a forward and rearward direction. A spinner having a plurality of propellers is coupled coaxially to the crankshaft 11.

An engine body 12 of the engine includes a crankcase 14 formed such that a left case half 13L disposed on the left side as the engine as viewed from the rear side and a right case half 13R disposed on the right side as the engine as viewed from the rear side are coupled to each other. The engine body 12 of the engine further includes left and right cylinder blocks 15L and 15R disposed on the left and right of the crankcase 14.

The left cylinder block 15L is formed as a unitary member from a left cylinder barrel 16L and a left cylinder head 17L while the right cylinder block 15R is formed as a unitary member from a right cylinder barrel 16R and a right cylinder head 17R. The left and right cylinder barrels 16L, 16R are coupled to the crankcase 14.

In the cylinder barrels 16L, 16R of the two cylinder blocks 15L and 15R, pairs of cylinder bores 18L, 18L; 18R, 18R sandwich the crankshaft 11 from the opposite sides that are opposed to each other are provided such that they are juxtaposed in the direction of the axial line of the crankshaft 11 and are offset from each other in the direction of the axial line. Pistons 20L, . . . , 20R, . . . are slidably fitted in the cylinder bores 18L, . . . , 18R, . . . such that combustion chambers 19L, . . . , 19R, . . . are formed between the pistons 20L, . . . , 20R, . . . and the cylinder heads 17L, 17R.

The two cylinder blocks 15L, 15R are disposed in an opposing relationship to each other such that the axial lines of the cylinder bores 18L, . . . , 18R, . . . extend substantially horizontally, and the crankshaft 11 connected to the pistons 20L, . . . , 20R, . . . through connecting rods 22L, . . . , 22R, . . . is rotatably supported on the crankcase 14.

Figure 3:
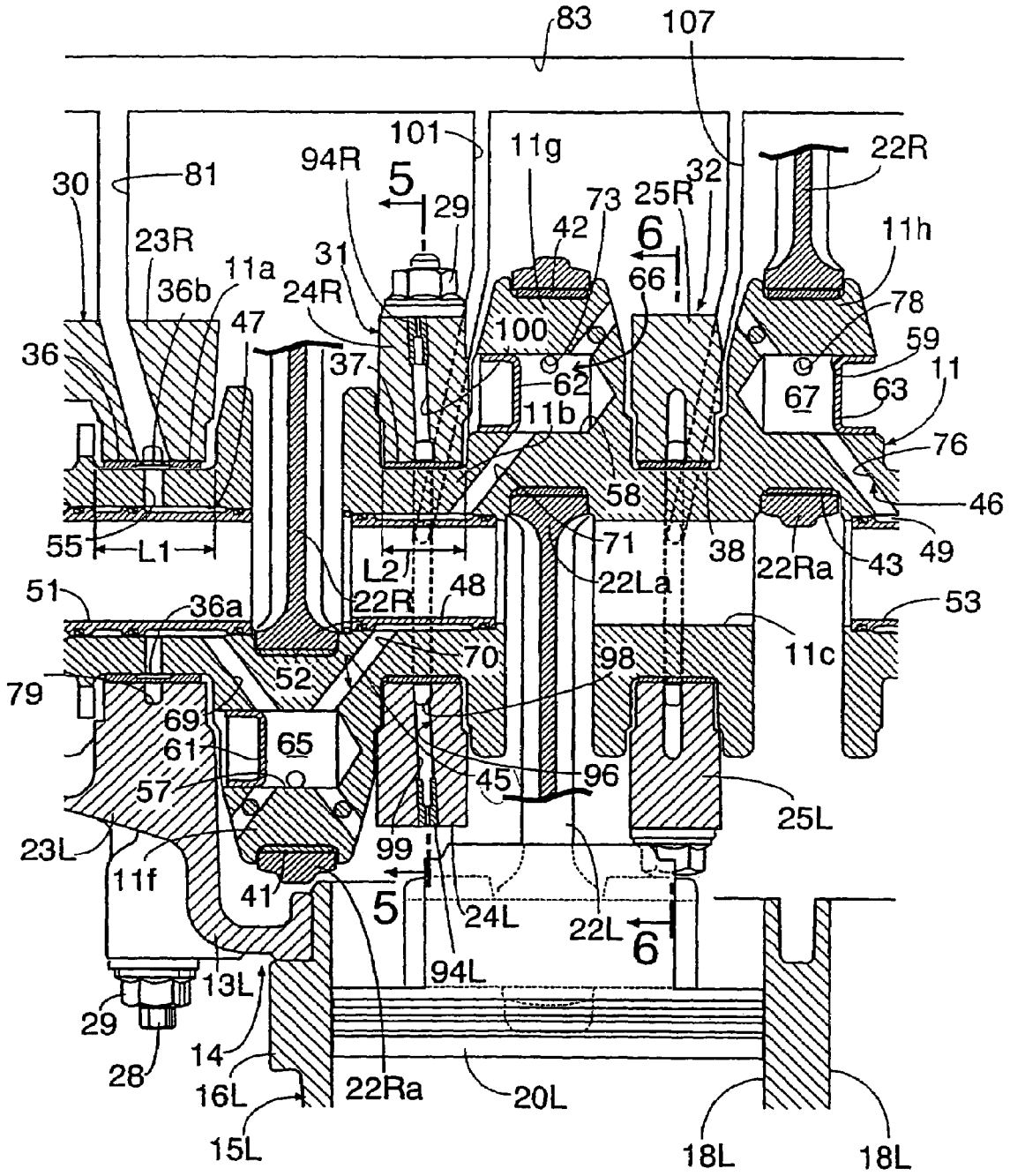
FIG. 3 is an enlarged sectional view of a part of FIG. 1 on the front side of a crankshaft.
Figure 4:
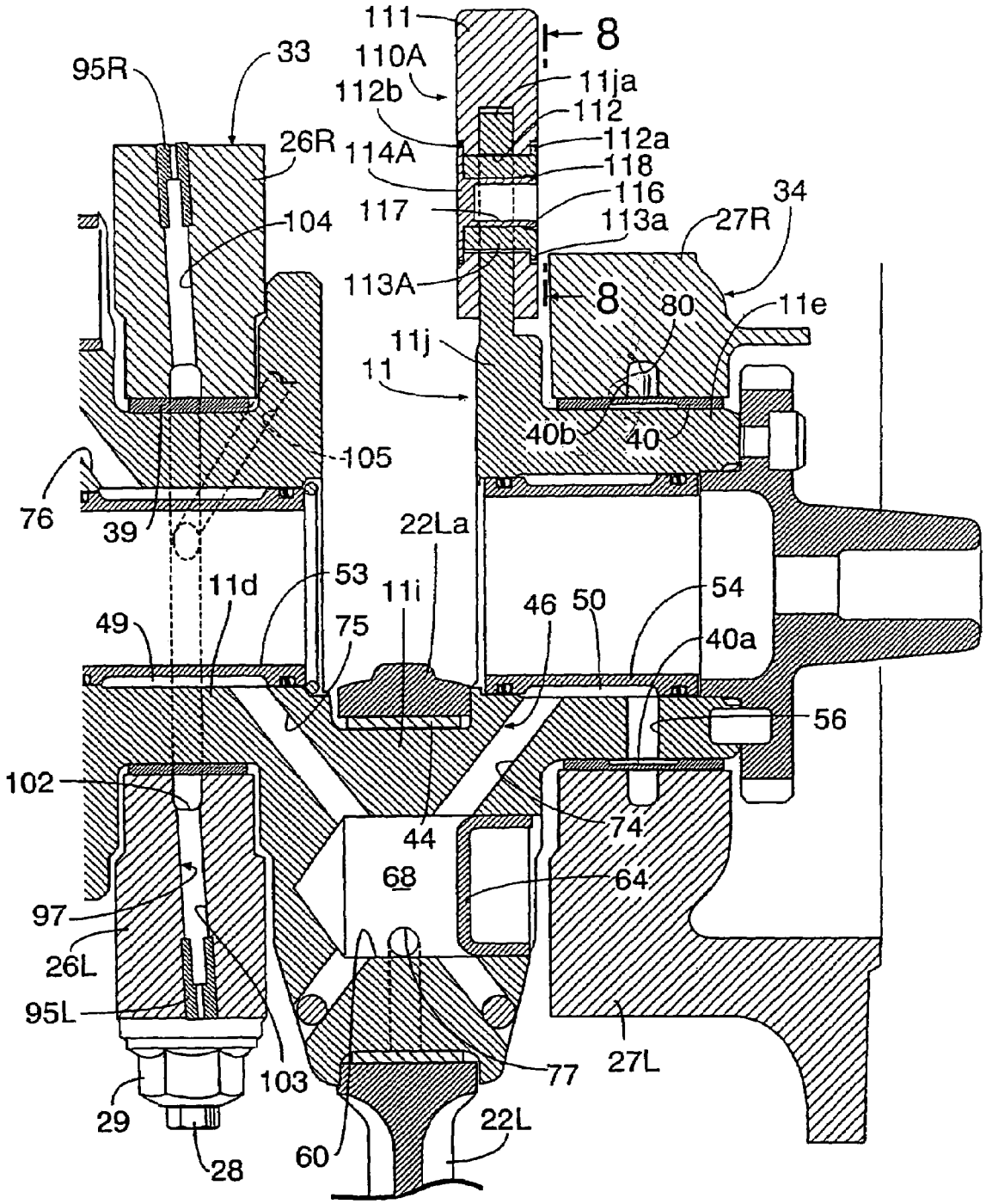
FIG. 4 is an enlarge sectional view of part of FIG. 1 on the rear side of the crankshaft.

Referring also to FIGS. 3 and 4, a front journal supporting wall 23L, a first intermediate journal supporting wall 24L, a second intermediate journal supporting wall 25L, a third intermediate journal supporting wall 26L and a rear journal supporting wall 27L are disposed in a spaced relationship from each other in the forward and rearward direction on the left case half 13L of the crankcase 14 and support the left half of the crankshaft 11 on the opposite front and rear sides of the connecting rods 22L, . . . . A front journal supporting wall 23R, a first intermediate journal supporting wall 24R, a second intermediate journal supporting wall 25R, a third intermediate journal supporting wall 26R and a rear journal supporting wall 27R are disposed in a spaced relationship from each other in the forward and rearward direction on the right case half 13R and support the right half of the crankshaft 11 on the opposite front and rear sides of the connecting rods 22R, . . . .

Figure 5:
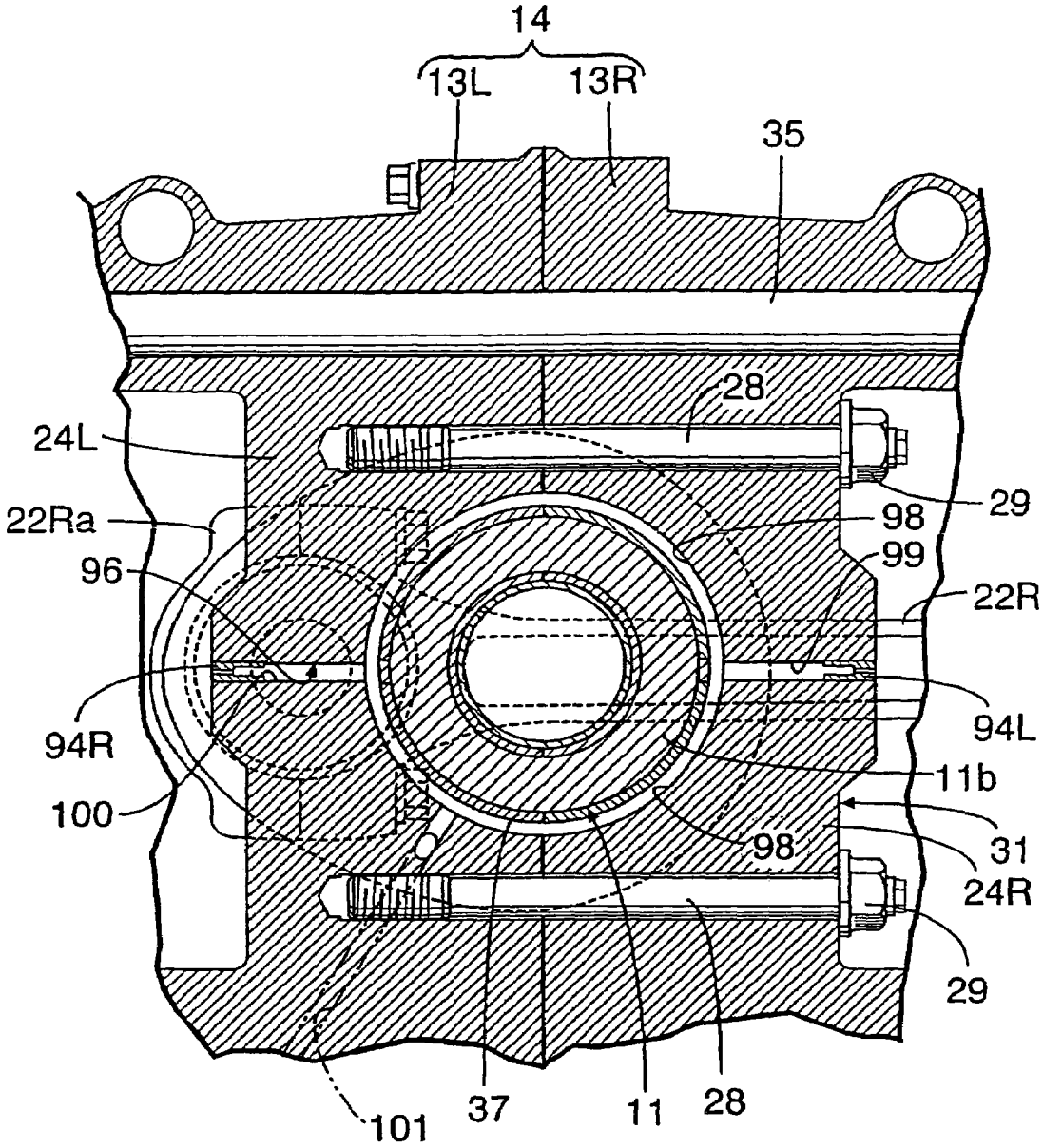
FIG. 5 is a sectional view taken along line 5—5 of FIG. 3.
Figure 6:
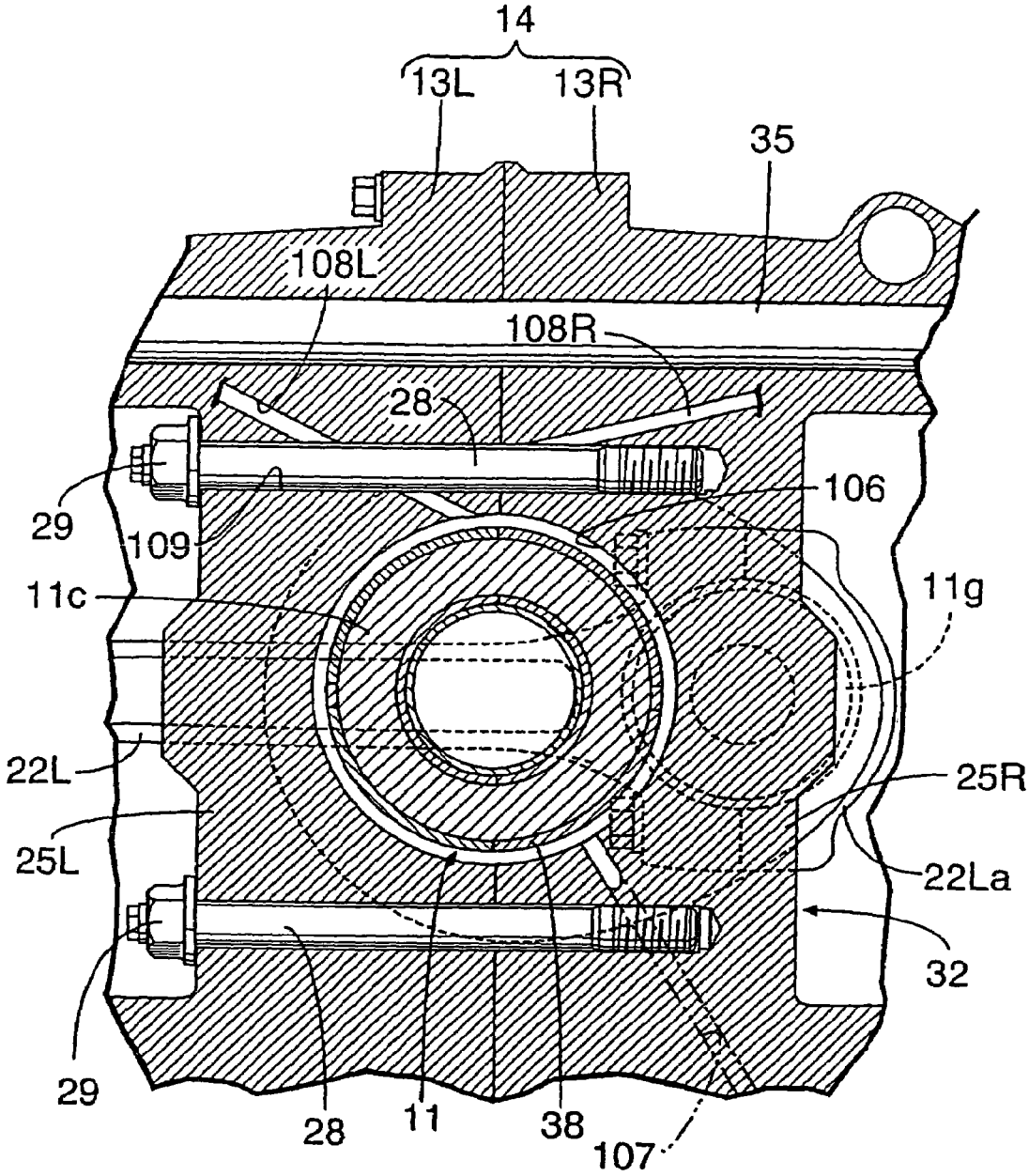
FIG. 6 is a sectional view taken along line 6—6 of FIG. 3.

Referring also to FIGS. 5 and 6, the journal supporting walls 23L to 27L and 23R to 27R are fastened to each other each by a pair of stud bolts 28, . . . and a pair of nuts 29, . . . sandwiching the crankshaft 11 from above and below thereby to form a front bearing portion 30, a first intermediate bearing portion 31, a second intermediate bearing portion 32, a third intermediate bearing portion 33 and a rear bearing portion 34 which rotatably support the crankshaft 11.

Incidentally, the stud bolts 28, . . . for fastening the front journal supporting walls 23L, 23R and the rear journal supporting walls 27L, 27R are formed longer than the stud bolts 28, . . . for fastening the first, second and third intermediate journal supporting walls 24L to 26L; 24R to 26R.

On the stud bolt 28 implanted in the front journal supporting wall 23R of the right case half 13R and fitted in the front journal supporting wall 23L of the left case half 13L, the nut 29 is screwed such that they engage with an outer face of the left case half 13L. On the stud bolt 28 implanted in the rear journal supporting wall 27L of the left case half 13L and fitted in the rear journal supporting wall 27R of the right case half 13R, the nut 29 is screwed such that they engage with an outer face of the left case half 13L.

On the stud bolts 28, . . . implanted in the second and third intermediate journal supporting walls 25R, 26R of the right case half 13R and fitted in the second and third intermediate journal supporting walls 25L, 26L of the left case half 13L, the nuts 29, . . . are screwed such that they engage with second and third intermediate journal supporting walls 25L, 26L. On the stud bolt 28 implanted in the first intermediate journal supporting wall 24L of the left case half 13L and fitted in the first intermediate journal supporting wall 24R of the right case half 13R, the nut 29 is screwed such that they engage with first intermediate journal supporting wall 24R.

The crankcase 14 and the left and right cylinder blocks 15L, 15R are fastened to each other in a compressed state in the direction along axial lines of a plurality of fastening bolts 35, . . . by the fastening bolts 35, . . . whose axial lines extend in parallel to the axial lines of the cylinder bores 18L, 18R, . . . .

The crankshaft 11 has a pair of outermost crank journals 11*a*, 11*e*, three crank journals 11*b*, 11*c*, 11*d*, crankpins 11*f*, 11*g* and crankpins 11*h*, 11*i* provided integrally thereon. The outermost crank journals 11*a*, 11*e* are disposed most outwardly along the axial line of the crankshaft 11. The crank journals 11*b*, 11*c*, 11*d* are disposed in a spaced relationship from each other between the two outermost crank journals 11*a*, 11*e*. Major ends 22Ra, 22Ra of the connecting rods 22R, 22R on the right cylinder block 15R side are pivotally connected to the crankpins 11*f*, 11*g* while major ends 22La, 22La of the connecting rods 22L, 22R on the left cylinder block 15L side are pivotally connected to the crankpins 11*h*, 11*i*.

The two outermost crank journals 11*a*, 11*e* are rotatably supported by the front and rear bearing portions 30, 34, respectively, and the three crank journals 11*b*, 11*c*, 11*d* except the outermost crank journals 11*a*, 11*e* are rotatably supported by the first, second and third intermediate bearing portions 31, 32, 33, respectively. In addition, the length L1 in the axial direction of the outermost crank journals 11*a*, 11*e* disposed most outwardly along the axial line of the crankshaft 11 from among the plural crank journals 11*a* to 11*e* provided on the crankshaft 11 is set to be greater than the length L2 in the axial direction of the remaining crank journals 11*b* to 11*d*. Accordingly, also the lengths in the axial direction of the front and rear bearing portions 30, 34 corresponding to the outermost crank journals 11*a*, 11*e* are set to be greater than the axial line length of the first to third intermediate bearing portions 31, 32, 33 corresponding to the remaining crank journals 11*b* to 11*d*.

Main metal bearings 36, 40 each in the form of a ring formed from a pair of half members are interposed between the two outermost crank journals 11*a*, 11*e* and the front and rear bearing portions 30, 34, and main metal bearings 37, 38, 39 each in the form of a ring formed from a pair of half members are interposed between the remaining crank journals 11*b* to 11*d* and the first, second and third intermediate bearing portions 31 to 33. Further, metal bearings 41, 43 each in the form of a ring formed from a pair of half members are interposed between the major ends 22R*a*, 22R*a* of the connecting rods 22R, 22R and the crankpins 11*f*, 11*h* of the crankshaft 11, and metal bearings 42, 44 each in the form of a ring formed from a pair of half members are interposed between the major ends 22La, 22La of the connecting rods 22L, 22L and the crankpins 11*g*, 11*i* of the crankshaft 11.

A pair of crankpin oil paths 45, 46 are provided in the crankshaft such that they extend from at least one of the opposite outermost crank journals 11*a*, 11*e*, in the present working example, from both of the outermost crank journals 11*a*, 11*e* to the crankpins 11*f*, 11*g*; 11*h*, 11*i*.

The crankpin oil path 45 is provided in the crankshaft 11 such that it extends from the outermost crank journal 11*a* to the crankpins 11*f*, 11*g* while the other crankpin oil path 46 is provided in the crankshaft 11 such that it extends from the outermost crank journal 11*e* to the crankpins 11*h*, 11*i*.

On and to the outermost crank journal 11*a*, first intermediate crank journal 11*b*, third intermediate crank journal 11*d* and outermost crank journal 11*e*, cylindrical collars 51, 52, 53, 54 are fitted and secured coaxially in order to achieve a reduction in the weight of the crankshaft 11 such that they cooperate with the crank journals 11*a*, 11*b*, 11*d*, 11*e* to form annular paths 47, 48, 49, 50 sealed at the opposite ends thereof in the axial direction.

Further, annular grooves 36*a*, 40*a* are provided on inner circumferences of the main metal bearings 36, 40 interposed between the outermost crank journals 11*a*, 11*e* and the front and rear bearing portions 30, 34, and a plurality of communicating holes 55, 56 for communicating the annular grooves 36*a*, 40*a* with the annular paths 47, 50 are provided in the outermost crank journals 11*a*, 11*e* in such a manner as to extend in radial directions. Further, bottomed holes 57, 58, 59, 60 for lightening are provided coaxially in the crankpins 11*f* to 11*i*, and 11*d* members 61, 62, 63, 64 for oil-tightly closing up open ends of the bottomed holes 57 to 60 are force fitted in the crankpins 11*f* to 11*i* while relay chambers 65, 66, 67, 68 are formed in the crankpins 11*f* to 11*i* between the closed ends of the bottomed holes 57 to 60 and the lid members 61 to 64.

A communicating hole 69 for interconnecting the annular path 47 and the relay chamber 65 is provided in the crankshaft 11 between the outermost crank journal 11*a* and the crankpin 11*f*. A communicating hole 70, for interconnecting the relay chamber 65 and the annular path 48, is provided in the crankshaft 11 between the crankpin 11*f* and the first intermediate crank journal 11*b*. Further, a communicating hole 71 for interconnecting the annular path 48 and the relay chamber 66 is provided in the crankshaft 11 between the first intermediate crank journal 11*b* and the crankpin 11*g*.

The crankpin oil path 45 is formed from the annular groove 36*a*, communicating hole 55, annular path 47, communicating hole 69, relay chamber 65, communicating hole 70, annular path 48, communicating hole 71 and relay chamber 66.

A communicating hole 72 for interconnecting an outer face of the crankpin 11*f* and the relay chamber 65 is provided in the crankpin 11*f* so as to supply oil between the metal bearing 41 and the crankpin 11*f*, and a communicating hole 73 for interconnecting an outer face of the crankpin 11*g* and the relay chamber 66 is provided in the crankpin 11*g* so as to supply oil between the metal bearing 42 and the crankpin 11*g*. In addition, the communicating holes 72, 73 are provided in the crankpins 11*f*, 11*g* such that they extend along inner circumferences of the bottomed holes 57, 58 most outwardly along a radial direction of the crankshaft 11 so that sludge in the oil can be discharged readily by the action of the centrifugal force.

The annular paths 47, 48 formed between the collars 51, 52 and the crank journals 11*a*, 11*b* are formed so as to raise the flow speed of oil to the utmost to reduce the area of flow therethrough to the utmost in order to prevent stagnation of the sludge in the oil.

A communicating hole 74 for interconnecting the annular path 50 and the relay chamber 68 is provided in the crankshaft 11 between the outermost crank journal 11*e* and the crankpin 11*i*. A communicating hole 75, for interconnecting the relay chamber 68 and the annular path 49, is provided in the crankshaft 11 between the crankpin 11*i* and the third intermediate crank journal 11*d*. Further, a communicating hole 76 for interconnecting the annular path 49 and the relay chamber 67 is provided in the crankshaft 11 between the third intermediate crank journal 11*b* and the crankpin 11*h*.

The other crankpin oil path 46 described above is formed from the annular groove 40*a*, communicating hole 56, annular path 50, communicating hole 74, relay chamber 68, communicating hole 75, annular path 49, communicating hole 76 and relay chamber 67.

A communicating hole 77 for interconnecting an outer face of the crankpin 11*i* and the relay chamber 68 is provided in the crankpin 11*i* so as to supply oil between the metal bearing 44 and the crankpin 11*i*, and a communicating hole 78 for interconnecting an outer face of the crankpin 11*h* and the relay chamber 67 is provided in the crankpin 11*h* so as to supply oil between the metal bearing 43 and the crankpin 11*h*. Further, the communicating holes 77, 78 are provided in the crankpins 11*i*, 11*h* such that they extend along inner circumferences of the bottomed holes 60, 59 most outwardly along a radial direction of the crankshaft 11 so that sludge can be discharged readily by an action of the centrifugal force. Further, the annular paths 49, 50 formed between the collars 53, 54 and the crankpins 11*h*, 11*i* are formed so as to raise the flow speed of the oil to the utmost to reduce the area of flow therethrough to the utmost in order to prevent stagnation of the sludge in the oil.

Annular recesses 79, 80 are provided on inner circumferences of the front and rear bearing portions 30, 34 in such a manner as to surround the main metal bearings 36, 40. Communicating holes 36*b*, 40*b* for communicating the annular recesses 79, 80 with the annular grooves 36*a*, 40*a* of the main metal bearings 36, 40, that is, the crankpin oil paths 45, 46, are provided on the main metal bearings 36, 40, respectively.

Figure 7:
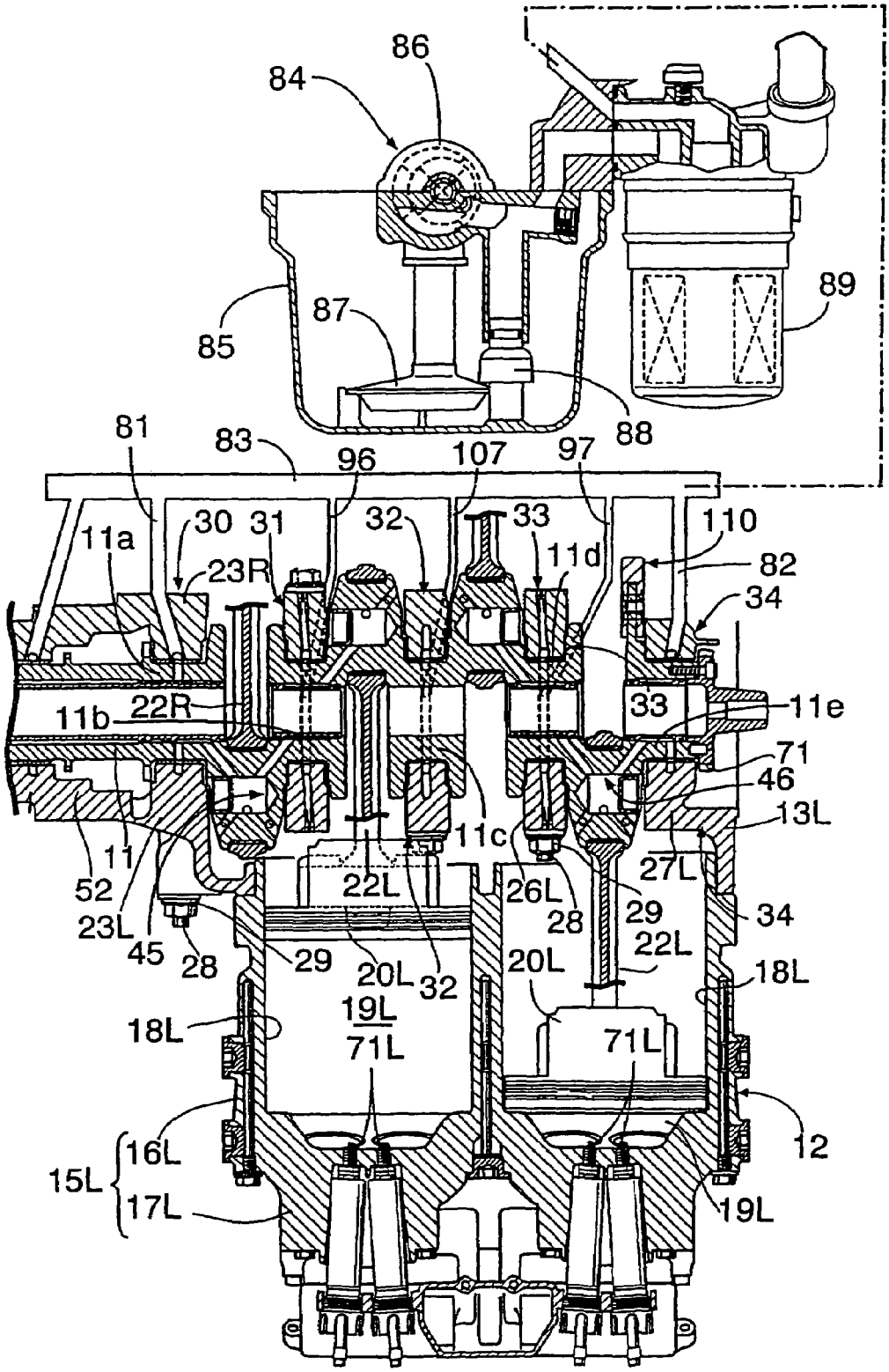
FIG. 7 is a transverse sectional view showing a lubrication system for the crankshaft.

Referring also to FIG. 7, oil supply paths 81, 82 are provided in the front and rear bearing portions 30, 34 such that they communicate with the annular recesses 79, 80, respectively. The oil supply paths 81, 82 are connected to an oil supply source 84 through a main gallery 83 provided in the crankcase 14 in such a manner as to extend in parallel to the crankshaft 11. In other words, the oil supply source 84 is connected to the crankpin oil paths 45, 46 at the outermost crank journals 11*a*, 11*e*.

The oil supply source 84 includes an oil pump 86, an oil strainer 87, a relief valve 88, and an oil filter 89. The oil pump 86 is partly accommodated in an oil pan 85 in such a manner as to be driven by power transmission from the crankshaft 11. The oil strainer 87 is connected to an intake port of the oil pump 86 in such a manner as to purify and supply oil in the oil pan 85 to the oil pump 86. The relief valve 88 is interposed between a discharge port of the oil pump 86 and the oil pan 85, and the oil filter 89 is connected to the discharge port of the oil pump 86. The oil filter 89 is connected to the main gallery 83.

Incidentally, the crankshaft 11 has three crank journals 11*b* to 11*d* except the outermost crank journals 11*a*, 11*e*, and oil jets 94L, 94R; 95L, 95R for jetting cooling oil toward the pistons 20L, . . . , 20R, . . . that are attached to the first and third intermediate bearing portions 31, 33 from among the first, second and third intermediate bearing portions 31, 32, 33 on which the crank journals 11*b* to 11*d* are rotatably supported, respectively. Further, oil jet oil paths 96, 97 for introducing oil to the oil jets 94L, 94R; 95L, 95R are provided in the first and third intermediate bearing portions 31, 33, respectively.

An annular recess 98 is provided on the first intermediate bearing portion 31 such that it surrounds the main metal bearing 37, and communicating holes 99, 100 for interconnecting the annular recess 98. The oil jets 94L, 94R are provided in the first intermediate bearing portion 31. The oil jet oil path 96 is formed from the annular recess 98 and communicating holes 99, 100 and a communicating hole 101 provided in the first intermediate bearing portion 31 in such a manner so as to communicate the annular recess 98 with the main gallery 83.

An annular recess 102 is provided on the third intermediate bearing portion 33 such that it surrounds the main metal bearing 39. Communicating holes 103, 104, for interconnecting the annular recess 102 and the oil jets 95L, 95R, are provided in the third intermediate bearing portion 33. The oil jet oil path 97 is formed from the annular recess 102 and communicating holes 103, 104, and a communicating hole 105 provided in the third intermediate bearing portion 33 in such a manner so as to communicate the annular recess 102 with the main gallery 83.

In particular, the oil jets 94L, 94R; 95L, 95R are attached to the first and third intermediate bearing portions 31, 33. The oil jet oil paths 96, 97 for introducing oil to the oil jets 94L, 94R; 95L, 95R are provided in the first and third intermediate bearing portions 31, 33. The oil jet oil paths 96, 97 are connected to the oil supply source 84 through the main gallery 83 while the crankpin oil paths 74, 75 and the oil jet oil paths 96, 97 are connected in parallel to the oil supply source 84.

Further, an annular recess 106 is provided on an inner circumference of the second intermediate bearing portion 32 such that it surrounds the main metal bearing 38, and a communicating hole 107 is provided in the second intermediate bearing portion 32 such that it communicates the main gallery 83 with the annular recess 106.

An annular chamber 109 is formed between one of the pair of stud bolts 28, 28, by which the second intermediate journal supporting walls 25L, 25R which cooperatively form the second intermediate bearing portion 32 are fastened to each other and the second intermediate journal supporting walls 25L, 25R. A communicating path 108L communicating with the annular recess 106 is provided in the second intermediate journal supporting wall 25L in such a manner as to introduce oil to the cylinder head 17L side through the cylinder barrel 16L. The communicating path 108L is disposed such that it crosses the annular chamber 109. Accordingly, oil is introduced also into the annular chamber 109, and a communicating path 108R communicating with the annular chamber 109 is provided in the second intermediate journal supporting wall 25R in such a manner as to introduce oil to the cylinder head 17R side through the cylinder barrel 16R.

Figure 8:
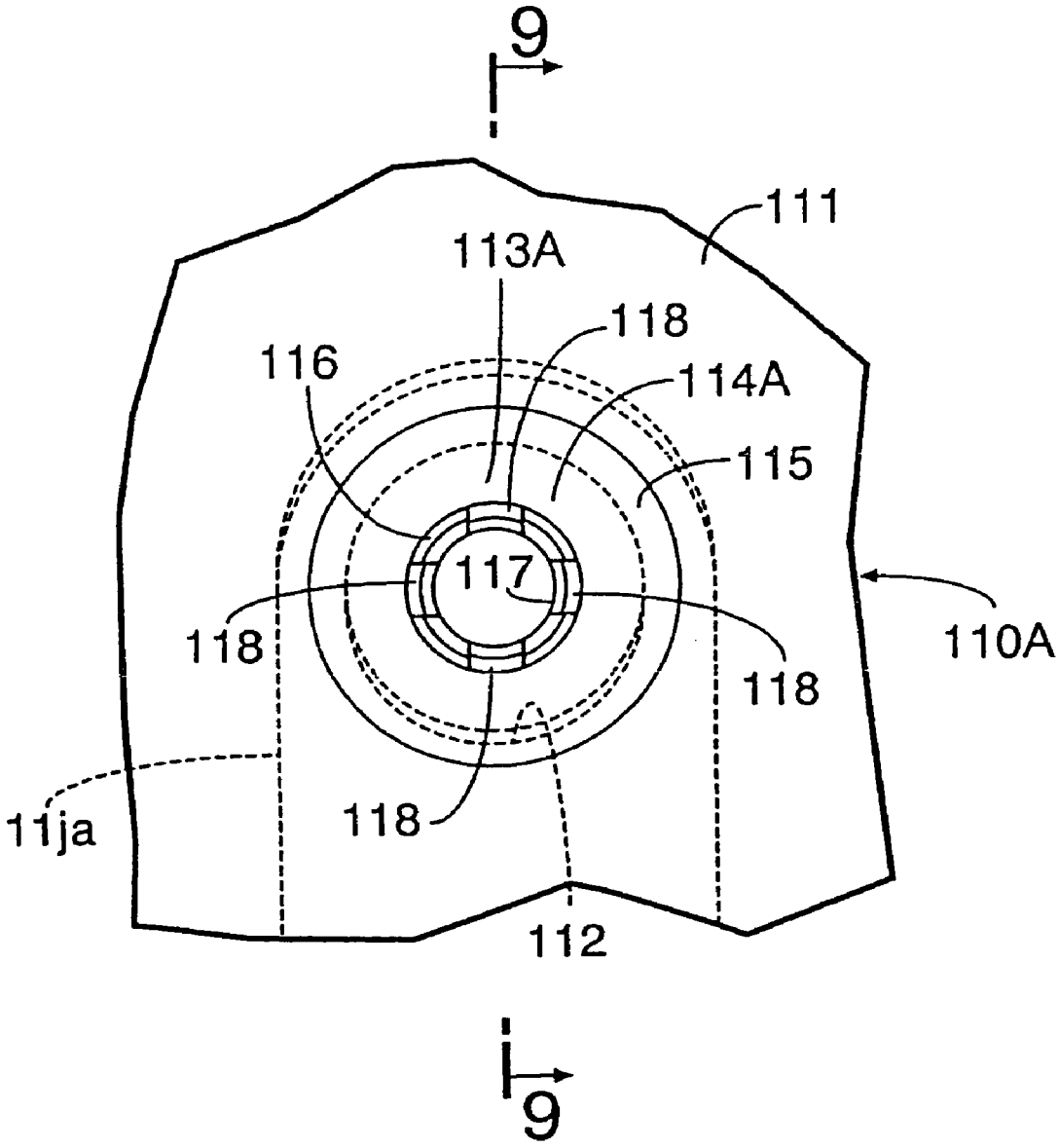
FIG. 8 is a view along line 8—8 of FIG. 4 as viewed in a direction indicated by an arrow mark.
Figure 9:
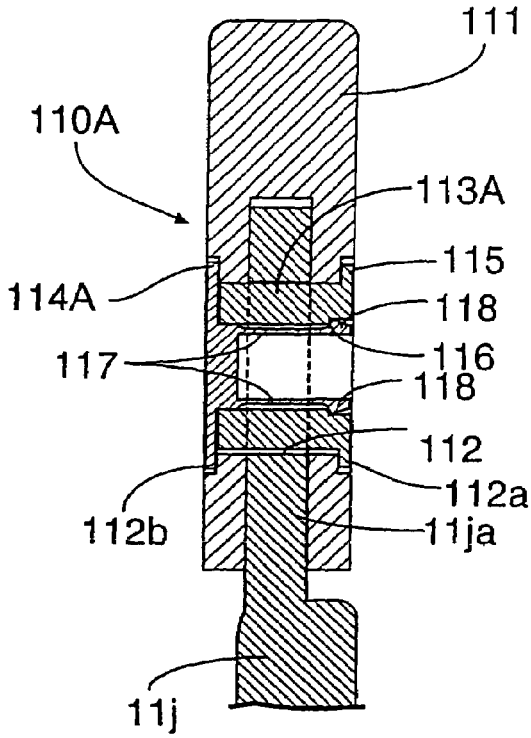
FIG. 9 is a sectional view taken along line 9—9.

Referring to FIGS. 8 and 9, a dynamic damper 110A for normally generating vibration damping oscillations of a magnitude equal to n times (nth order) of the speed of rotation irrespective of the speed of rotation making use of the fact that the centrifugal force increases in proportion to the square of the speed of rotation is mounted on a crank web 11*j* adjacent the outermost crank journal 11*e* on the crankshaft 11. The dynamic damper 110A is formed from a supporting arm portion 11*ja* in the form of a thin plate provided on the crank web 11*j* and a weight 111 attached to the supporting arm portion 11*ja* such that it can rotate around an axial line parallel to the crankshaft 11.

The weight 111 is formed in a substantially U-shape such that it sandwiches the supporting arm portion 11*ja* from the opposite sides. An shaft hole 112 parallel to the crankshaft 11 is provided in the supporting arm portion 11*ja* and the weight 111. Annular stepped portions 112*a*, 112*b* exposed to the outside are formed at the opposite end portions of the shaft hole 112.

A cylindrical pin 113A is inserted in the shaft hole 112, and a flange portion 115 is provided on an outer circumference of an end of the pin 113A such that it engages with the stepped portion 112*a* of the shaft hole 112 while an annular locking stepped portion 116 is provided on an inner circumference of the end portion of the pin 113A. A cap 114A made of a synthetic resin material contacts with the other end of the pin 113A and engages with the other stepped portion 112*b*. A plurality of, for example, four, leg portions 117, . . . are provided integrally on the cap 114A and inserted in the pin 113A. Engaging pawls 118, . . . are provided at ends of the leg portions 117, . . . and resiliently engage with the locking stepped portion 116 of the pin 113A.

In the present embodiment, the dynamic damper 110A is mounted on the crank web 11*j* positioned closely to the inner face of the crankcase 14. Since the installation space is restricted, it is necessary to form the weight 111 with a thickness as small as possible and make the length of the pin 113A for supporting the weight 11 on the supporting arm portion 11*ja* as small as possible. However, where the pin 113A is engaged with the stepped portion 112*a* on one end side of the shaft hole 112 provided on the weight 111 in such a manner as to be held flush with one face of the weight 111 and the cap 114A is engaged with the stepped portion 112*b* on the other end side of the shaft hole 112 provided on the weight 111 in such a manner as to be held flush with the other face of the weight 111 and is resiliently engaged with the inner circumferential portion on the one end side of the pin 113A as described above, the effective length of the pin 113A is increased while the opposite ends of the pin 113A are prevented from projecting from the opposite faces of the weight 111 thereby to allow installation of the dynamic damper 110A in the restricted installation space.

Now, the operation of the present working example will be described. The crankshaft 11 includes the plural outermost crank journals 11*a* to 11*e* rotatably supported through the main metal bearings 36 to 40 on the plural bearing portions 30 to 34 provided on the crankcase 14. The length in the axial direction of the pair of outermost crank journals 11*a*, 11*e* disposed most outwardly along the axial line of the crankshaft 11 from among the outermost crank journals 11*a* to 11*e* is set to be greater than the length in the axial direction of the remaining crank journals 11*b* to 11*d*. Further, the crankpin oil paths 45, 46 extending from at least one (in the present embodiment, from both) of the two outermost crank journals 11*a*, 11*e* to the crankpins 11*f* to 11*i* are provided in the crankshaft 11. The oil supply source 84 is connected to the crankpin oil paths 45, 46 at the outermost crank journals 11*a*, 11*e*.

The outermost crank journals 11*a*, 11*e* do not have a significant influence on an increase in the scale of the engine in the direction along the axial line of the crankshaft 11 even if the length thereof in the axial direction is set to be long to some degree. The crankpin oil paths 45, 46 extending to the crankpins 11*f* to 11*i* from the outermost crank journals 11*a*, 11*e* whose length in the axial direction is set to a comparatively great length in this manner are provided in the crankshaft 11. Consequently, in the remaining crank journals 11*b* to 11*d* except the outermost crank journals 11*a*, 11*e*, there is no necessity to provide annular oil grooves on the main metal bearings 37 to 39 for feeding of oil to and from the crankpin oil paths 45, 46, and the load capacity of the main metal bearings 37 to 39 can be assured sufficiently even with the remaining crank journals 11*b* to 11*d* whose length in the axial direction is set comparatively small. Accordingly, while a reduction of the load capacity of all of the main metal bearings 36 to 40 is avoided to achieve a reduction in the scale and the weight of the engine, lubricating oil can be supplied between the major end portions 22La, . . . , 22Ra, . . . of the connecting rods 22L, . . . , 22R, . . . and the crankpins 11*f* to 11*i*.

Further, to the bearing portions selected from among the bearing portions 31, 32, 33 for rotatably supporting the first, second and third intermediate crank journals 11*b*, 11*c*, 11*d*, in the present embodiment, to the first and third intermediate bearing portions 31 and 33, the oil jets 94L, 94R; 95L, 95R for jetting cooling oil toward the pistons 20L, . . . , 20R, . . . fitted for sliding movement in the cylinder bores 18L, . . . , 18R, . . . are attached. Further, the oil jet oil paths 96, 97 for introducing oil to the oil jets 94L, 94R; 95L, 95R are provided in the first and third intermediate bearing portions 31 and 33. The crankpin oil paths 45, 46 and the oil jet oil paths 96, 97 are connected in parallel to the oil supply source 84.

Accordingly, while the pistons 20L, . . . , 20R, . . . are cooled by the oil jets 94L, 94R; 95L, 95R, a sufficient amount of oil can be supplied between the major end portions 22La, . . . , 22Ra, . . . of the connecting rods 22L, . . . , 22R, . . . and the crankpins 11*f* to 11*i*, and this can contribute to an improvement in the durability.

Further, since the pair of left and right cylinder barrels 16L, 16R having the cylinder bores 18L, . . . , 18R, . . . offset in the direction along the axial line of the crankshaft 11 are coupled to the crankcase 14, the present invention can be applied suitably to such a horizontally opposed type multi-cylinder engine as in the present working example or a V-type multi-cylinder engine.

Figure 10:
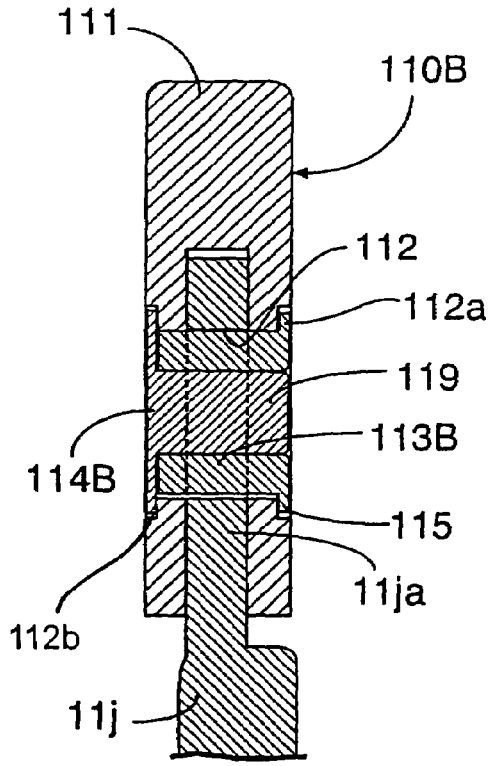
FIG. 10 is a sectional view showing a first modification to a dynamic damper in a corresponding relationship to FIG. 9.

FIG. 10 shows a first modification to the dynamic damper. A cylindrical pin 113B is inserted in a shaft hole 112 provided in the weight 111 of the dynamic damper 110B and the supporting arm portion 11*ja*. The pin 113B has, on an outer circumference at an end thereof, a flange portion 115 which engages with the stepped portion 112*a* on one end side of the shaft hole 112. A cap 114B contacts with the other end of the pin 113B and engages with the stepped portion 112*b* on the other end side of the shaft hole 112. A shaft portion 119 is provided on the cap 114B and force fitted in the pin 113B.

Figure 11:
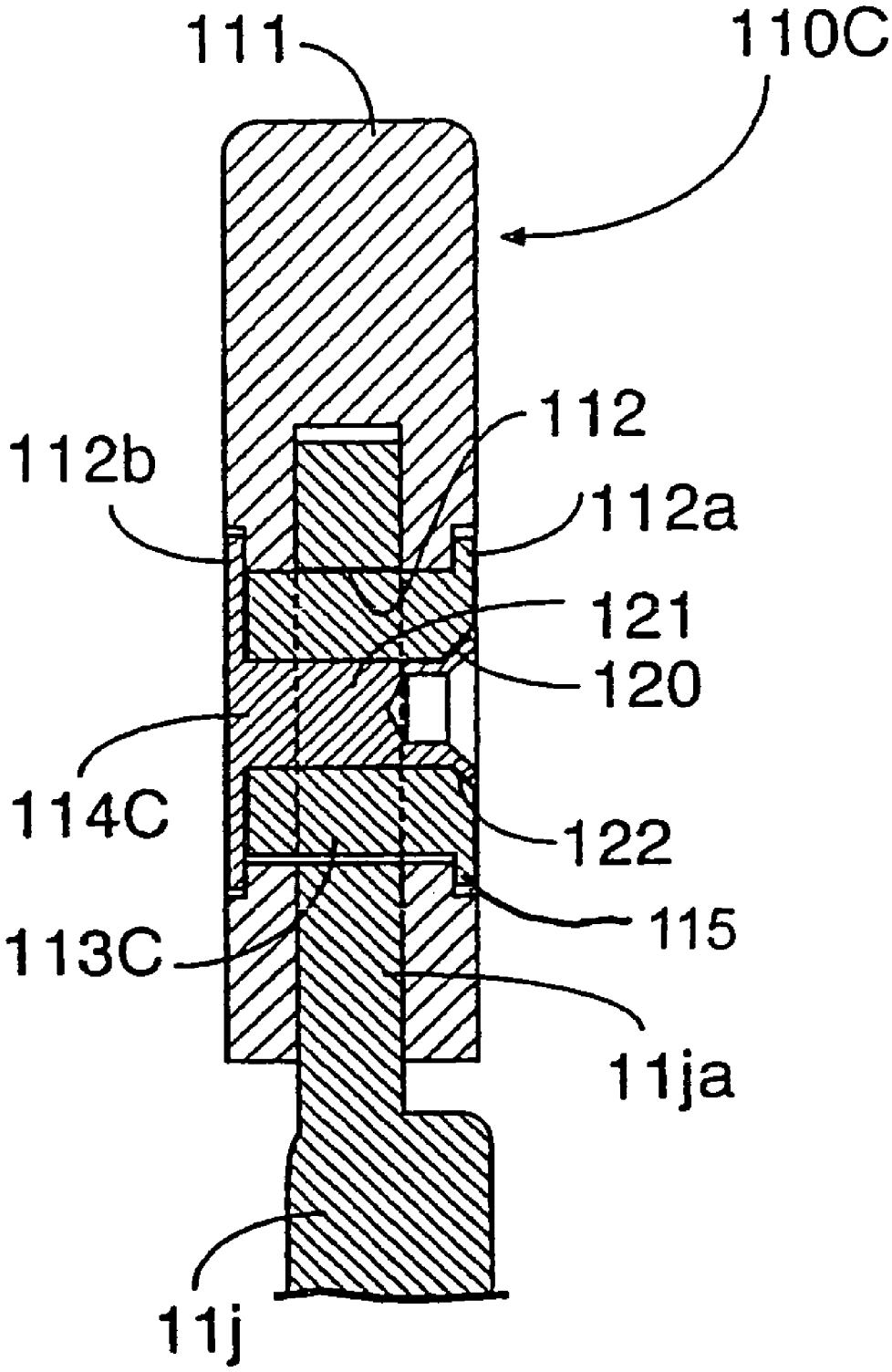
FIG. 11 is a sectional view showing a second modification to the dynamic damper in a corresponding relationship to FIG. 9.

FIG. 11 shows a second modification to the dynamic damper. A shaft hole 112 is provided in the weight 111 of the dynamic damper 110C and the supporting arm portion 11*ja*, and a cylindrical pin 113C is inserted in the shaft hole 112. The pin 113C has, on an outer circumference at one end thereof, a flange portion 115 for engaging with the stepped portion 112*a* on one end side of the shaft hole 112. A tapering locking portion 120 is provided on an inner circumferential portion on one end side of the pin 113C. Meanwhile, a cap 114C contacts with the other end of the pin 113C and engages with the stepped portion 112*b* on the other end side of the shaft hole 112. A shaft portion 121 is provided on the cap 114C and is inserted in the pin 113C. A thin cylindrical portion 122 is provided coaxially at an end portion of the shaft portion 121 and engaged with the locking portion 120 by caulking.

Also with the first and second modifications as described above, the opposite ends of the pin 113B or 113C can be prevented from projecting from the opposite faces of the weight 111 to make the effective length of the pin 113B or 113C great thereby to allow the dynamic damper 110B or 110C to be installed in the limited installation space.

While a working example of the present invention has been described, the present invention is not limited to the working example described above but can be modified in various manners without departing from the present invention as set forth in the claims.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A multi-cylinder engine wherein, in a crankshaft on which a plurality of crank journals are individually rotatably supported through main metal bearings on a plurality of bearing portions provided on a crankcase and crankpins to which major end portions of connecting rods are pivotally connected are provided integrally, crankpin oil paths for supplying lubricating oil between said major end portions of said connecting rods and said crankpins, wherein:

the pair of outermost crank journals disposed most outwardly along an axial line of said crankshaft from among said plurality of crank journals have a length in the axial direction set greater than the length of the remaining crank journals in the axial direction;

annular grooves being provided on inner circumferences of the main metal bearings interposed between the outermost crank journals and front and rear bearing portions; and said crankpin oil paths extending from at least one of the two outermost crank journals to said crankpins are provided in said crankshaft while an oil supply source is connected to said crankpin oil paths at least at one of said outermost crank journals.

2. The multi-cylinder engine according to claim 1, wherein oil jets for jetting cooling oil toward pistons slidably fitted in cylinder bores are attached to selected ones of said bearing portions on which the remaining crank journals are rotatably supported and oil jetting oil paths for introducing the oil to said oil jets are provided in the selected bearing portions and said crankpin oil paths and said oil jetting oil paths are connected in parallel to said oil supply source.

3. The multi-cylinder engine according to claim 1, wherein a pair of cylinder barrels having said cylinder bores offset in a direction along the axial line of said crankshaft are coupled to said crankcase.

4. The multi-cylinder engine according to claim 2, wherein a pair of cylinder barrels having said cylinder bores offset in a direction along the axial line of said crankshaft are coupled to said crankcase.

5. The multi-cylinder engine according to claim 1, wherein the outermost crank journal, a first intermediate crank journal, a third intermediate crank journal and an outermost crank journal each include a collar for fitting and being secured coaxially relative thereto for reducing the weight of the crankshaft and cooperating with the crank journals for forming annular paths sealed at opposite ends thereof in the axial direction.

6. The multi-cylinder engine according to claim 5, and further including a plurality of communicating holes for communicating annular grooves with corresponding annular paths provided in the outermost crank journals so as to extend in the radial directions.

7. The multi-cylinder engine according to claim 5, and further including bottomed holes for lightening the crankshaft, said bottomed holes being formed coaxially in the crankpins and lid members for providing an oil-tight closing for the bottomed holes.

8. The multi-cylinder engine according to claim 5, and further including a communicating hole for interconnecting an outermost annular path and a relay chamber and further including a communicating hole for interconnecting the relay chamber with a first intermediate crank journal annular path.

9. The multi-cylinder engine according to claim 8, and further including a communicating hole for interconnecting the first intermediate crank journal annular path and a second relay chamber and further including a communicating hole for interconnecting the second relay chamber with a third relay chamber disposed outwardly in a radial direction wherein sludge in the oil is discharged readily by an action of the centrifugal force.

10. The multi-cylinder engine according to claim 1, and further including a dynamic damper for normally generating vibration damping oscillations of a magnitude equal to a predetermined number times the speed of rotation of the crankshaft.

11. A multi-cylinder engine comprising:

a crankshaft;

a plurality of crank journals being individually rotatably supported on the crankshaft through main bearings on a plurality of bearing portions provided on a crankcase;

crankpins pivotally connected to major end portions of connecting rods;

crankpin oil paths for supplying lubricating oil between said major end portions of said connecting rods and said crankpins;

a pair of outermost crank journals disposed at each end of the crankshaft along an axial line of said crankshaft as compared to the remaining of said plurality of crank journals each outermost crank journal having a length in the axial direction set greater than the length of the remaining crank journals in the axial direction; and annular grooves being provided on inner circumferences of the main metal bearings interposed between the outermost crank journals and front and rear bearing portions;

said crankpin oil paths extending from at least one of the two outermost crank journals to said crankpins are provided in said crankshaft while an oil supply source is connected to said crankpin oil paths at least at one of said outermost crank journals.

12. The multi-cylinder engine according to claim 11, wherein oil jets for jetting cooling oil toward pistons slidably fitted in cylinder bores are attached to selected ones of said bearing portions on which the remaining crank journals are rotatably supported and oil jetting oil paths for introducing the oil to said oil jets are provided in the selected bearing portions and said crankpin oil paths and said oil jetting oil paths are connected in parallel to said oil supply source.

13. The multi-cylinder engine according to claim 11, wherein a pair of cylinder barrels having said cylinder bores offset in a direction along the axial line of said crankshaft are coupled to said crankcase.

14. The multi-cylinder engine according to claim 12, wherein a pair of cylinder barrels having said cylinder bores offset in a direction along the axial line of said crankshaft are coupled to said crankcase.

15. The multi-cylinder engine according to claim 11, wherein the outermost crank journal, a first intermediate crank journal, a third intermediate crank journal and an outermost crank journal each include a collar for fitting and being secured coaxially relative thereto for reducing the weight of the crankshaft and cooperating with the crank journals for forming annular paths sealed at opposite ends thereof in the axial direction.

16. The multi-cylinder engine according to claim 15, and further including a plurality of communicating holes for communicating annular grooves with corresponding annular paths provided in the outermost crank journals so as to extend in the radial directions.

17. The multi-cylinder engine according to claim 15, and further including bottomed holes for lightening the crankshaft, said bottomed holes being formed coaxially in the crankpins and lid members for providing an oil-tight closing for the bottomed holes.

18. The multi-cylinder engine according to claim 15, and further including a communicating hole for interconnecting an outermost annular path and a relay chamber and further including a communicating hole for interconnecting the relay chamber with a first intermediate crank joumal annular path.

19. The multi-cylinder engine according to claim 18, and further including a communicating hole for interconnecting the first intermediate crank joumal annular path and a second relay chamber and further including a communicating hole for interconnecting the second relay chamber with a third relay chamber disposed outwardly in a radial direction wherein sludge in the oil is discharged readily by an action of the centrifugal force.

20. The multi-cylinder engine according to claim 11, and further including a dynamic damper for normally generating vibration damping oscillations of a magnitude equal to a predetermined number times the speed of rotation of the crankshaft.

* * * * *